US009484682B2

(12) United States Patent
Ni et al.

(10) Patent No.: US 9,484,682 B2
(45) Date of Patent: Nov. 1, 2016

(54) USB SOCKET

(71) Applicant: Wenzhou MTLC Electric Co., Ltd, Yueqing, Zhejiang (CN)

(72) Inventors: Lidong Ni, Yueqing (CN); Wei Gao, Zhejiang (CN)

(73) Assignee: Wenzhou MTLC Electric Co., Ltd, Yueqing, Zhejiang (CN)

( * ) Notice: Subject to any disclaimer, the term of this patent is extended or adjusted under 35 U.S.C. 154(b) by 0 days.

(21) Appl. No.: 14/742,470

(22) Filed: Jun. 17, 2015

(65) Prior Publication Data

US 2016/0233621 A1 Aug. 11, 2016

(30) Foreign Application Priority Data

Feb. 6, 2015 (CN) ..... 2015 1 0063774
Feb. 6, 2015 (CN) ..... 2015 2 0086516 U

(51) Int. Cl.
*H01R 13/66* (2006.01)
*H01R 27/02* (2006.01)

(52) U.S. Cl.
CPC ..... *H01R 13/665* (2013.01); *H01R 27/02* (2013.01)

(58) Field of Classification Search
CPC ..... H01R 2201/04; H01R 24/52
See application file for complete search history.

(56) References Cited

U.S. PATENT DOCUMENTS 7,736,033 B2 * 6/2010 Patel ..... F21S 6/002 307/43
8,158,883 B2 * 4/2012 Soffer ..... H02G 3/123 174/480
8,547,056 B2 * 10/2013 Chang ..... H02J 7/0042 320/107
2008/0303803 A1 * 12/2008 O'Brien ..... G06F 3/0481 345/184
2011/0272959 A1 * 11/2011 Lupton, III ..... B60R 7/06 296/37.8
2014/0248802 A1 * 9/2014 Hieda ..... H04L 12/2818 439/620.01
2015/0038006 A1 * 2/2015 Jansen ..... H02J 7/0021 439/535

* cited by examiner

*Primary Examiner* — Truc Nguyen
(74) *Attorney, Agent, or Firm* — Ziegler IP Law Group, LLC

(57) ABSTRACT

A USB socket includes a socket body, an upper cover, at least one USB interface disposed in the socket body, and a power supply conversion structure for converting an external power supply to a power supply suitable for output of the USB interface. A USB jack is disposed on the upper cover at a position corresponding to the USB interface, the upper cover is detachably mounted on the socket body, the USB interface is mounted at a lower side of the upper cover, and when the upper cover is mounted to the socket body, the USB interface inserts into the socket body. A moving contact is electrically connected to the USB interface, a fixed contact electrically connected to the power supply conversion structure is further disposed in the socket body and the moving contact is driven to be in contact conduction with the fixed contact.

10 Claims, 5 Drawing Sheets

USB SOCKET

TECHNICAL FIELD

The aspects of the disclosed embodiments relate generally to the field of sockets, and in particular, to a USB socket having a replaceable upper cover.

BACKGROUND

With the popularization of electronic devices such as mobile phones and digital cameras, people now use charging power supplies of these electronic products more frequently. Currently, people generally charge an electronic product by directly inserting an interface of a USB data cable into a USB socket, and since the USB data cable is frequently plugged into and pulled out from the USB socket, a USB interface of the USB socket may be loosened or damaged over time so that or the whole USB socket must be discarded.

For example, Chinese patent document CN has disclosed a double safety socket having a USB interface, including a socket case, and a pin clip, a USB interface, a PWB board and a safety gate that are disposed in the socket case. The PWB is provided with a power supply circuit, the pin clip is connected to an input end of the power supply circuit, an output end of the power supply circuit is connected to the USB interface, the safety gate shields an upper end of the pin clip, a part of the safety gate extending beyond two sides of the socket case is a safety push handle, and pushing the safety push handle may push away the safety gate shielding the upper end of the pin clip, so as to expose the pin clip. The socket may be directly connected to a power supply pin of an electrical device, and may also be connected to a USB data cable, thereby improving the practicability of the socket; the safety gate disposed in the socket effectively protects an internal circuit of the socket, thereby preventing situations such as short circuit or electric shock, and improving the safety of using the socket.

In the above patent document, the double safety socket has the USB interface directly mounted on the PWB board in the socket body, and the PWB board is further electrically connected to the power supply circuit; therefore, after the USB interface is loosened or damaged due to frequent plugging and pulling, a user cannot replace the USB interface, so that the whole socket loses the function of charging an electronic device and becomes a common socket, which results in reduced utilization of the socket, and brings inconvenience to the user.

SUMMARY

Therefore, a technical problem to be solved by the aspects of the disclosed embodiments lies in that: in a USB socket of the prior art, a loose or damaged USB interface cannot be replaced, so that the whole USB socket loses the function of charging an electronic device and becomes a common socket; and directed to the above problem, a USB socket capable of enabling a user to replace a USB interface conveniently and having a long service life is provided.

To solve the above technical problem, a USB socket of the disclosed embodiments includes a socket body, an upper cover disposed on an upper part of the socket body, at least one USB interface disposed in the socket body, and a power supply conversion structure for converting an external power supply to a power supply suitable for output of a USB interface. A USB jack used to insert a USB plug in is disposed on the upper cover at a position corresponding to the USB interface, the upper cover is detachably mounted on the socket body, the USB interface is integrally mounted at a lower side of the upper cover, and when the upper cover is mounted to the socket body, the USB interface inserts into the socket body.

A moving contact is electrically connected to the USB interface in an integral manner, a fixed contact electrically connected to the power supply conversion structure is further disposed in the socket body at a corresponding position, and in a process of plugging the USB plug into the USB interface, the moving contact is driven to be in contact conduction with the fixed contact.

In the USB socket of the disclosed embodiments, an upper cover seat is further fixedly mounted at an upper end of the socket body, an insertion through cavity, in communication with the inside of the socket body and suitable for the USB interface to pass through, is formed on the upper cover seat, and the upper cover is detachably mounted on the upper cover seat.

In the USB socket of the disclosed embodiments, the USB interface and the moving contact are both mounted on the first circuit board, and the two are electrically connected by using the first circuit board; the fixed contact is mounted on a second circuit board, and the second circuit board and the power supply conversion structure are electrically connected by using two wires.

In the USB socket of the disclosed embodiments, the moving contact is elastic, and in the process of plugging the USB plug into the USB interface, the moving contact is deformed to be in contact conduction with the fixed contact.

In the USB socket of the disclosed embodiments, the power supply conversion structure is a third circuit board.

In the USB socket of the disclosed embodiments, two USB interfaces are disposed, correspondingly, two moving contacts and two fixed contacts are disposed, the two USB interfaces and the two moving contacts are disposed on the same first circuit board, and the two fixed contacts are disposed on the same second circuit board.

In the USB socket of the disclosed embodiments, the USB socket further includes a common socket, where a grounded blade as well as a first reed and a second reed, respectively connected to a live wire and a neutral wire of the external power supply, of the common socket are all disposed in the socket body, a socket hole is formed on the upper cover at a corresponding position, and a middle through hole is formed on the upper cover seat at a corresponding position.

In the USB socket of the disclosed embodiments, a mounting room is disposed at a lower side of the upper cover, the USB interface, the first circuit board and the moving contact are integrally disposed in the mounting room, an open groove for exposing the moving contact is further formed on the mounting room, a clamp structure is disposed between an outer sidewall of the mounting room and the upper cover seat, and the upper cover is detachably connected to the upper cover seat by using the clamp structure.

In the USB socket of the disclosed embodiments, the clamp structure includes an elastic buckle disposed inside the socket body, a combination portion formed on a sidewall of the mounting room, and a groove formed on a sidewall of the insertion through cavity and provided for the combination portion to pass, and the combination portion is inserted into the insertion through cavity along with the mounting room, and is combined and connected to the elastic buckle.

In the USB socket of the disclosed embodiments, a guide slot along an insertion direction of the mounting room is further formed on an inner sidewall of the upper cover seat, and a guide rib matching with the guide slot is formed on the sidewall of the mounting room.

In the USB socket of the disclosed embodiments, the socket body includes a bottom case, and a base connected to an upper end of the bottom case, the third circuit board is mounted in the bottom case, the base is longitudinally partitioned into two cavities, the mounting room, the second circuit board and the fixed contact on the second circuit board are disposed in a first cavity, and the grounded blade, the first reed and the second reed of the common socket are disposed in a second cavity.

Compared with the prior art, the above technical solution of the disclosed embodiments has the following advantages:

1. In the disclosed embodiments, a moving contact and a fixed contact relatively separated are disposed between a USB interface and a power supply output end of a power supply conversion structure, the moving contact and the USB interface are integrally disposed on an upper cover, and the fixed contact is fixed disposed in a socket body, so that the conducted moving contact and fixed contact do not have a fixed connection relationship, and therefore, when the USB interface is loose or damaged, the upper cover may be directly pulled out, so as to replace an upper cover provided with a USB interface and a moving contact, thereby prolonging the service life of the USB socket, reducing the use cost of the user, and avoiding waste of the whole socket.

2. In the disclosed embodiments, the USB socket integrates a USB interface and a common socket, so as to increase the function of the USB socket, and improve the utilization of the USB socket.

3. In the disclosed embodiments, the USB interface, the first circuit board and the moving contact are integrated in the mounting room, and the clamp structure between the mounting room and the upper cover seat as well as the socket body is disposed to facilitate mounting and replacement of the upper cover on the upper cover seat, and meanwhile protect the USB interface, the first circuit board and the moving contact.

These and other aspects, implementation forms, and advantages of the exemplary embodiments will become apparent from the embodiments described below considered in conjunction with the accompanying drawings. It is to be understood, however, that the description and drawings are designed solely for purposes of illustration and not as a definition of the limits of the disclosed invention, for which reference should be made to the appended claims. Additional aspects and advantages of the invention will be set forth in the description that follows, and in part will be obvious from the description, or may be learned by practice of the invention. Moreover, the aspects and advantages of the invention may be realized and obtained by means of the instrumentalities and combinations particularly pointed out in the appended claims.

BRIEF DESCRIPTION OF THE DRAWINGS

In the following detailed portion of the present disclosure, the invention will be explained in more detail with reference to the example embodiments shown in the drawings, in which.

Figure 1:
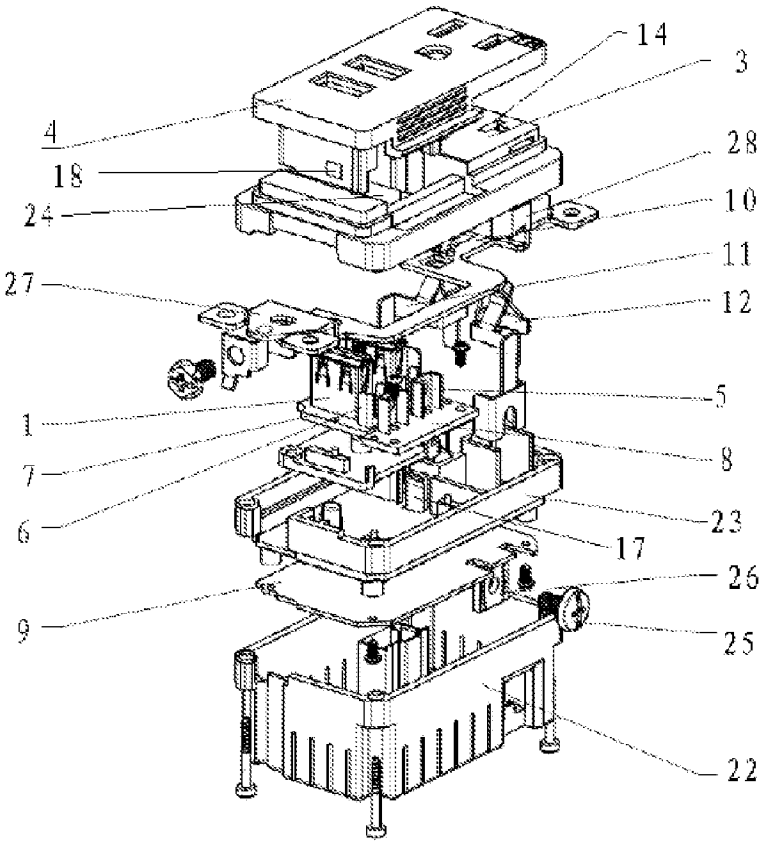
FIG. 1 is an exploded view of a USB socket according to the disclosed embodiments.
Figure 2:
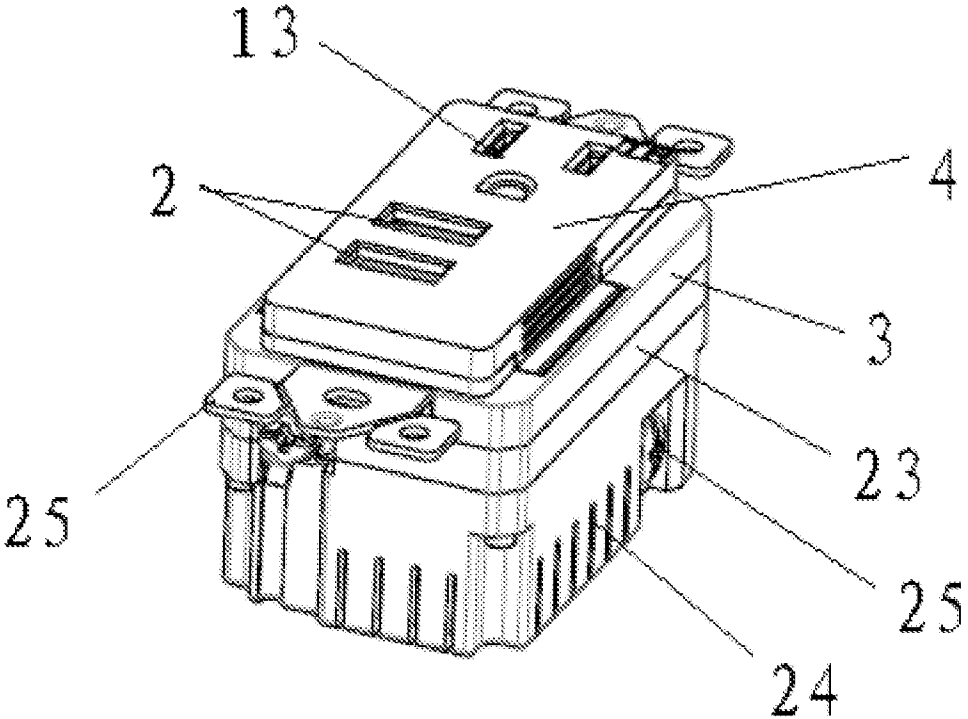
FIG. 2 is a three-dimensional view of a USB socket according to the disclosed embodiments.
Figure 3:
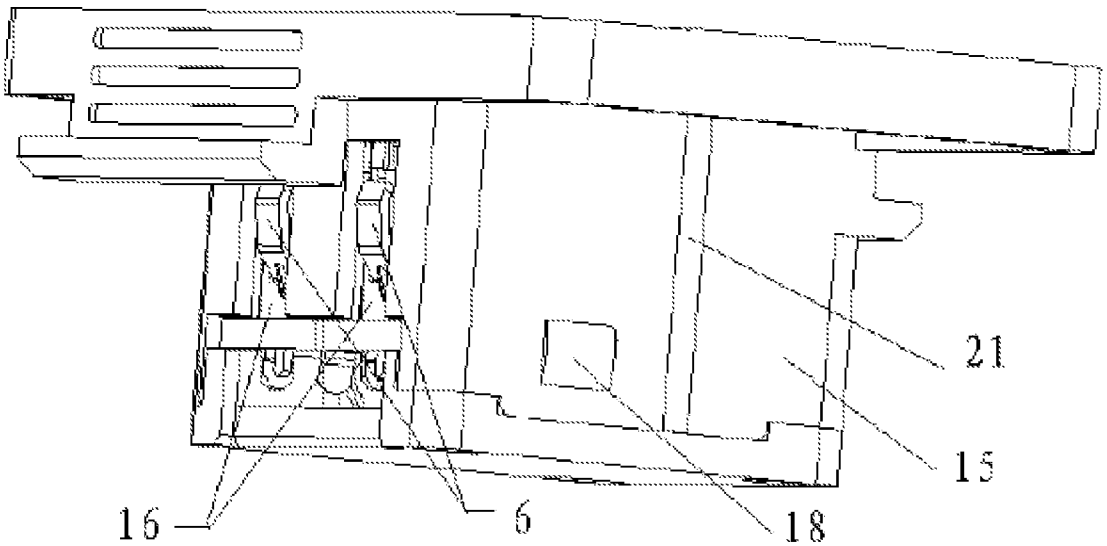
FIG. 3 is a three-dimensional view of an upper cover according to the disclosed embodiments.
Figure 4:
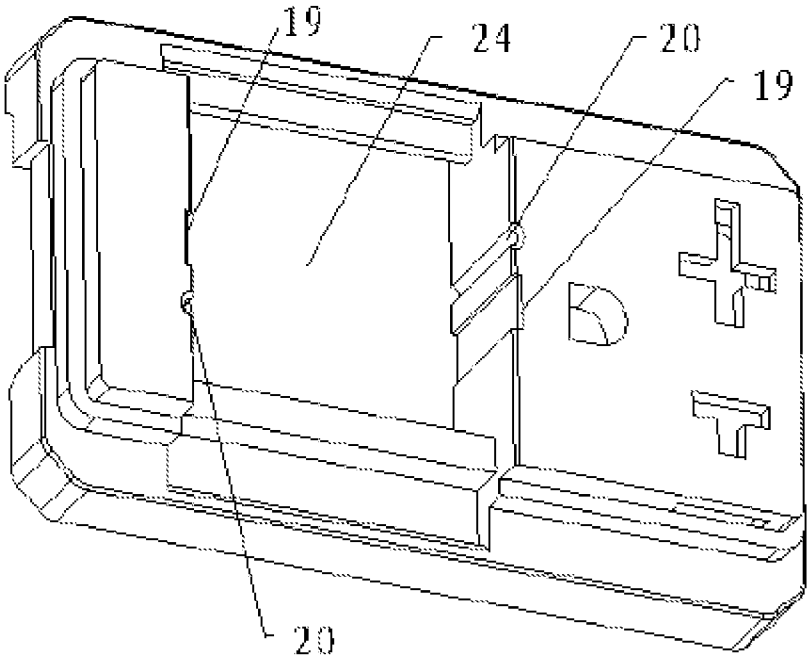
FIG. 4 is a three-dimensional view of an upper cover seat according to the disclosed embodiments.
Figure 5:
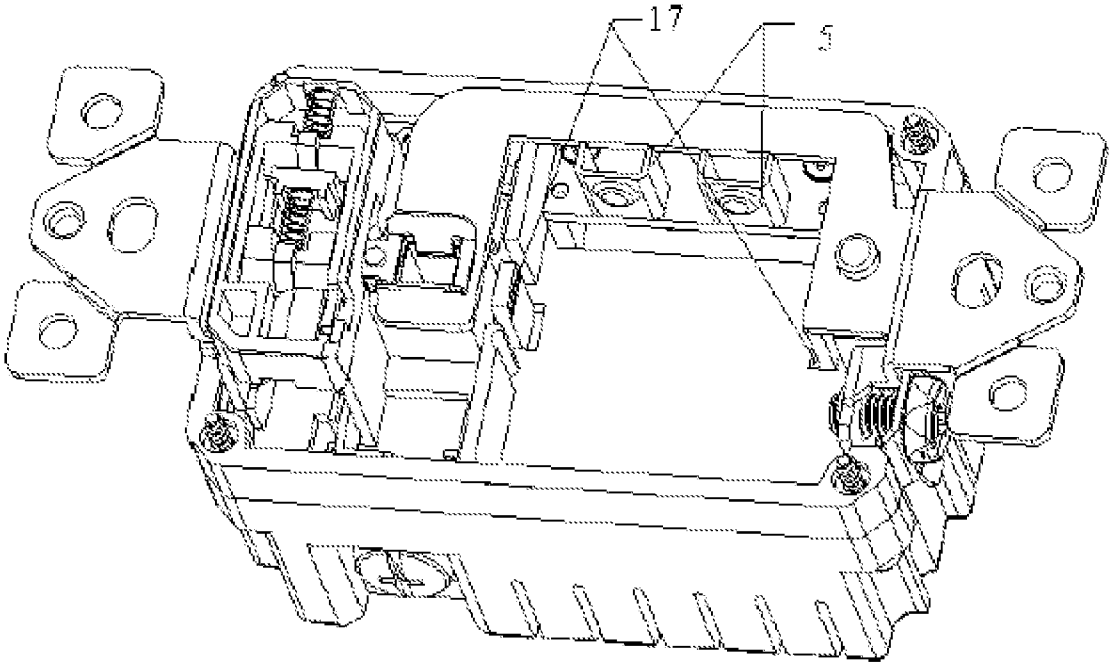
FIG. 5 is a three-dimensional view of a USB socket according to the disclosed embodiments after an upper cover and an upper cover seat are hidden.

In the drawings, reference numerals are: 1-USB interface; 2-USB jack; S-upper cover seat; 4-upper cover; 5-fixed contact; 6-moving contact; 7-first circuit board; 8-second circuit board; 9-third circuit board; 10-grounded blade; 11-first reed; 12-second reed; 13-socket hole; 14-middle through hole; 15-mounting room; 16-open groove; 17-elastic buckle; 18-combination portion; 19-groove; 20-guide slot; 21-guide rib; 22-bottom case; 23-base; 24-insertion through cavity; 25-terminal screw; 26-pressing piece; 27-mounting support; and 28-safety gate.

DETAILED DESCRIPTION OF THE DISCLOSED EMBODIMENTS

As shown in FIG. 1 to FIG. 5, a USB socket of the disclosed embodiments includes a socket body, an upper cover disposed at an upper part of the socket body, at least one USB interface 1 disposed in the socket body, and a power supply conversion structure for converting an external power supply to a power supply suitable for output of the USB interface 1. A USB jack 2 used to insert a USB plug or connector (not shown) in is formed on the upper cover 4 at a position corresponding to the USB interface 1, the upper cover 4 is detachably mounted on the socket body, the USB interface 1 is integrally mounted at a lower side of the upper cover, and when the upper cover 4 is mounted to the socket body, the USB interface 1 inserts into the socket body.

A moving contact 6 is electrically connected to the USB interface 1 in an integral manner, a fixed contact 5 electrically connected to the power supply conversion structure is further disposed in the socket body at a corresponding position, and in a process of plugging the USB plug into the USB interface 1, the moving contact 6 is driven to be in contact conduction with the fixed contact 5.

The above solution is a core solution of the disclosed embodiments, by disposing the moving contact 6 and the fixed contact 5 relatively separated between the USB interface 1 and a power supply output end of the power supply conversion structure, integrally disposing the moving contact 6 and the USB interface 1 on the upper cover 4, and fixedly disposing the fixed contact 5 in the socket body, the conducted moving contact 6 and fixed contact 5 do not have a fixed connection relationship, and therefore, when the USB interface 1 is loose or damaged, the upper cover 4 may be directly pulled out, so as to replace an upper cover 4 provided with a USB interface and a moving contact, thereby prolonging the service life of the USB socket, reducing the use cost of the user, and avoiding waste of the whole socket.

To facilitate mounting and forming of various parts, an upper cover seat 3 is further fixedly mounted at an upper end of the socket body, an insertion through cavity 24, in communication with inside of the socket body and suitable for the USB interface 1 to pass through, is formed on the upper cover seat 3, and the upper cover 4 is detachably mounted on the upper cover seat 3.

In this embodiment, the USB interface 1 and the moving contact 6 are both mounted on the first circuit board 7, and the two are electrically connected by using the first circuit board 7; the fixed contact 5 is mounted on a second circuit board 8, the second circuit board 8 and the power supply conversion structure are electrically connected by using two wires. The power supply conversion structure is generally set as a third circuit board 9. The third circuit board can perform voltage reduction, rectification, and filtering processes on the external power supply, and output at a stabilized voltage. Generally, a current of "5V, 4A" that is suitable for output of the USB interface is output after processing of the third circuit board.

In this embodiment, preferably, the moving contact 6 is elastic, the moving contact 6 and the fixed contact 5 are generally configured as copper components, and are disposed relatively separated. In this way, in a process of plugging the USB plug into the USB interface 1, the moving contact 6 is deformed to be in contact conduction with the fixed contact 5.

In the disclosed embodiments, multiple USB interfaces may be disposed on the USB socket, and in this embodiment disposing two USB interfaces is used as an example for description. As shown in FIG. 1, two USB interfaces 1 are disposed, and correspondingly, two moving contacts 6 and two fixed contacts 5 are disposed, the two USB interfaces 1 and the two moving contacts 6 are disposed on the same first circuit board 7, and the two fixed contacts 5 are disposed on the same second circuit board 8.

Further, the USB socket of the disclosed embodiments further includes a common socket, where a grounded blade 10 as well as a first reed 11 and a second reed 12, respectively connected to a live wire and a neutral wire of an external power supply, of the common socket are disposed in the socket body, a socket hole 13 for a plug to plug in is formed on the upper cover 4 at a corresponding position, and a middle through hole 14 is formed on the upper cover seat 3 at a corresponding position. The common socket may be configured as a socket of any type according to an actual situation.

A mounting room 15 is disposed at a lower side of the upper cover 4, the USB interface 1, the first circuit board 7 and the moving contact 6 are integrally disposed in the mounting room 15, an open groove 16 for exposing the moving contact 6 is further formed on the mounting room 15, a clamp structure is disposed between an outer sidewall of the mounting room 15 and the upper cover seat 3, and the upper cover 4 is detachably connected to the upper cover seat 3 by using the clamp structure, so that the USB interface 1, the first circuit board 7 and the moving contact 6 are integrated into a module disposed on the upper cover 4, so as to facilitate mounting and replacement of the upper cover on the upper cover seat.

There are many structures for the clamp structure, in this embodiment, preferably, the clamp structure includes an elastic buckle 17 disposed in the socket body, a combination portion 18 formed on a sidewall of the mounting room 15, and a groove 19 formed on a sidewall of the insertion through cavity 24 is used for the combination portion 18 to pass through. The combination portion 18 is inserted into the insertion through cavity 24 along with the mounting room 15, so as to be joined and connected to the clamp. To ensure that the upper cover 4 can be inserted and clamped precisely, a guide slot 20 along an insertion direction of the mounting room 15 is further formed on an inner sidewall of the upper cover seat 3, and a guide rib 21 matching with the guide slot 20 is formed on the sidewall of the mounting room 15.

The socket body includes a bottom case 22, and a base 23 connected to an upper end of the bottom case 22. The third circuit board 9 is mounted in the bottom case 22, the base 23 is longitudinally partitioned into two cavities, where the mounting room 15, the second circuit board 8 and the fixed contact 5 on the second circuit board 8 are located in a first cavity, and the grounded blade 10, the first reed 11 and the second reed 12 of the common socket are located in a second cavity. The above structure enables an ordered layout of the components in the socket body.

In the disclosed embodiments, the bottom case 22, the base 23 and the upper cover seat of the USB socket are connected through a screw; a wire of the external power supply is led from the bottom of the bottom case 22, and is connected to a pressing piece 26 by using a terminal screw 25. A mounting support 27 is further mounted between the base and the bottom case, and the USB socket of the disclosed embodiments is fixed to a wall or another structure by using the mounting support. A safety gate 28 is further disposed between the upper cover seat and the first reed 11, the second reed 12 as well as the grounded blade.

Thus, while there have been shown, described and pointed out, fundamental novel features of the invention as applied to the exemplary embodiments thereof, it will be understood that various omissions and substitutions and changes in the form and details of devices and methods illustrated, and in their operation, may be made by those skilled in the art without departing from the spirit and scope of the invention. Moreover, it is expressly intended that all combinations of those elements, which perform substantially the same function in substantially the same way to achieve the same results, are within the scope of the invention. Moreover, it should be recognized that structures and/or elements shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

What is claimed is:

1. A USB socket, comprising a socket body, an upper cover disposed on an upper part of the socket body, at least one USB interface (1) disposed in the socket body, and a power supply conversion structure for converting an external power supply to a power supply suitable for output of a USB interface (1), and a USB jack (2) used to insert a USB plug in being disposed on the upper cover (4) at a position corresponding to the USB interface (1), wherein: the upper cover (4) is detachably mounted on the socket body, the USB interface (1) is integrally mounted at a lower side of the upper cover, and when the upper cover (4) is mounted to the socket body, the USB interface (1) inserts into the socket body; and a moving contact (6) is electrically connected to the USB interface (1) in an integral manner, a fixed contact (5) electrically connected to the power supply conversion structure is further formed in the socket body at a corresponding position, and in a process of plugging the USB plug into the USB interface (1), the moving contact (6) is driven to be in contact conduction with the fixed contact (5) and wherein:

the USB interface (1) and the moving contact (6) are both mounted on the first circuit board (7), and the USB interface and moving contact are electrically connected by using the first circuit board (7); the fixed contact (5) is mounted on a second circuit board (8), and the second circuit board (8) and the power supply conversion structure are electrically connected by using two wires.

2. The USB socket according to claim 1, wherein: an upper cover seat (3) is further fixedly mounted on an upper end of the socket body, an insertion through cavity (24), in communication with the inside of the socket body and suitable for the USB interface (1) to pass through, is formed on the upper cover seat (3), and the upper cover (4) is detachably mounted on the upper cover seat (3).

3. The USB socket according to claim 1, wherein: the moving contact (6) is elastic, and in the process of plugging the USB plug into the USB interface (1), the moving contact (6) is deformed to be in contact conduction with the fixed contact (5).

4. The USB socket according to claim 3, wherein: the power supply conversion structure is a third circuit board (9).

5. The USB socket according to claim 4, wherein: two USB interfaces (1) are disposed, correspondingly, two moving contacts and two fixed contacts (5) are disposed, the two USB interfaces (1) and the two moving contacts (6) are disposed on the same first circuit board (7), and the two fixed contacts (5) are disposed on the same second circuit board (8).

6. The USB socket according to claim 5, wherein: the USB socket further comprises a common socket, a grounded blade (10) as well as a first reed (11) and a second reed (12), respectively connected to a live wire and a neutral wire of the external power supply, of the common socket are disposed in the socket body, a socket hole (13) is formed on the upper cover (4) at a corresponding position, and a middle through hole (14) is formed on the upper cover seat (3) at a corresponding position.

7. The USB socket according to claim 6, wherein: a mounting room (15) is disposed at a lower side of the upper cover (4), the USB interface (1), the first circuit board (7) and the moving contact (6) are integrally disposed in the mounting room (15), an open groove (16) for exposing the moving contact (6) is further formed on the mounting room (15), a clamp structure is disposed between an outer sidewall of the mounting room (15) and the upper cover seat (3), and the upper cover (4) is detachably connected to the upper cover seat (3) by using the clamp structure.

8. The USB socket according to claim 7, wherein: the clamp structure comprises an elastic buckle (17) disposed inside the socket body, a combination portion (18) formed on a sidewall of the mounting room (15), and a groove (19) formed on a sidewall of the insertion through cavity (24) and provided for the combination portion (18) to pass, and the combination portion (18) is inserted into the insertion through cavity (24) along with the mounting room (15), and is combined and connected to the elastic buckle.

9. The USB socket according to claim 8, wherein: a guide slot (20) along an insertion direction of the mounting room (15) is further formed on an inner sidewall of the upper cover seat (3), and a guide rib (21) matching with the guide slot (20) is formed on the sidewall of the mounting room (15).

10. The USB socket according to claim 9, wherein: the socket body comprises a bottom case (22), and a base (23) connected to an upper end of the bottom case (22), the third circuit board (9) is mounted in the bottom case (22), the base (23) is longitudinally partitioned into two cavities, the mounting room (15), the second circuit board (8) and the fixed contact (5) on the second circuit board (8) are disposed in a first cavity, and the grounded blade (10), the first reed (11), and the second reed (12) of the common socket are disposed in a second cavity.

* * * * *